US009879957B2

(12) United States Patent
Moser et al.

(10) Patent No.: US 9,879,957 B2
(45) Date of Patent: Jan. 30, 2018

(54) SHOTSHELL HAVING WAD WITH ENHANCED FIN DEPLOYMENT

(71) Applicant: Vista Outdoor Operations LLC, Farmington, UT (US)

(72) Inventors: Adam J. Moser, Big Lake, MN (US); Erik K. Carlson, Oak Grove, MN (US); Matthew S. Schroeder, Princeton, MN (US); Gary Hendrickson, Blaine, MN (US); Frank Gerzina, Otsego, MN (US)

(73) Assignee: Vista Outdoor Operations LLC, Farmington, UT (US)

( * ) Notice: Subject to any disclaimer, the term of this patent is extended or adjusted under 35 U.S.C. 154(b) by 0 days.

(21) Appl. No.: 15/295,700

(22) Filed: Oct. 17, 2016

(65) Prior Publication Data

US 2017/0108318 A1 Apr. 20, 2017

Related U.S. Application Data

(60) Provisional application No. 62/242,177, filed on Oct. 15, 2015.

(51) Int. Cl.
*F42B 7/08* (2006.01)
*F42B 7/04* (2006.01)

(52) U.S. Cl.
CPC ..... *F42B 7/08* (2013.01); *F42B 7/043* (2013.01)

(58) Field of Classification Search
CPC ..... F42B 7/08; F42B 7/043
See application file for complete search history.

(56) References Cited

U.S. PATENT DOCUMENTS 1,864,916 A 6/1932 Gachassin-Lafite
3,279,375 A * 10/1966 Herter ..... F42B 7/08 102/451
3,299,813 A 1/1967 Rickey
(Continued)

FOREIGN PATENT DOCUMENTS

DE 201048 6/1983
FR 92430 11/1968
(Continued)

OTHER PUBLICATIONS

Sabot Designs LLC, "Long Range Flechette Sabots", 1998-2001.

*Primary Examiner* — Stephen Johnson
*Assistant Examiner* — Joshua T Semick
(74) *Attorney, Agent, or Firm* — Christensen, Fonder, Dardi & Herbert PLLC

(57) ABSTRACT

A shotgun shell has a polymer wad with a forward shot cup portion and a rearward propellant cup, the wad in a casing, shot in the shot cup, propellant in the propellant cup, and a primer. The rearward propellant cup portion having enhanced fin deployment such that the shells are operative with shotguns with no chokes, shotguns with ported chokes, and shotguns with conventional chokes. The forward shot cup portion has axial slits that are sized to preclude shot from passing therethrough while providing sufficient air circulation to provide compaction relief of the shot pack. The enhancement may include gussets on the fins, axially movable disks to engage cam surfaces on the fins and urge them outwardly, and fins that have reduced bending regions compared to prior art wads.

13 Claims, 6 Drawing Sheets

(56) References Cited

U.S. PATENT DOCUMENTS

| | | | | | |
|---|---|---|---|---|---|
| 3,516,360 | A | | 6/1970 | Lathrope et al. | |
| 3,623,431 | A | * | 11/1971 | Hendricks | F42B 7/08 102/450 |
| 3,670,650 | A | * | 6/1972 | McCaffrey | F42B 7/08 102/450 |
| 3,974,770 | A | * | 8/1976 | Clark, Jr. | F42B 7/08 102/451 |
| 3,974,775 | A | | 8/1976 | Kerzman et al. | |
| 4,295,426 | A | | 10/1981 | Genco et al. | |
| D365,867 | S | | 1/1996 | Flanagan | |
| 5,644,100 | A | * | 7/1997 | Puckett | F42B 7/08 102/449 |
| 5,874,689 | A | | 2/1999 | Alkhatib et al. | |
| 5,970,878 | A | * | 10/1999 | Gardner | F42B 7/08 102/449 |
| 6,260,484 | B1 | * | 7/2001 | Billings | F42B 10/50 102/453 |
| 6,539,873 | B2 | * | 4/2003 | Diller | F42B 7/08 102/449 |
| 2015/0176954 | A1 | * | 6/2015 | Burczynski | F42B 7/04 102/451 |

FOREIGN PATENT DOCUMENTS

| | | | | | |
|---|---|---|---|---|---|
| FR | 2257890 | A1 | * | 8/1975 | F42B 7/08 |
| FR | 2257890 | A1 | * | 8/1975 | F42B 7/08 |
| FR | 2559892 | | | 8/1985 | |

* cited by examiner

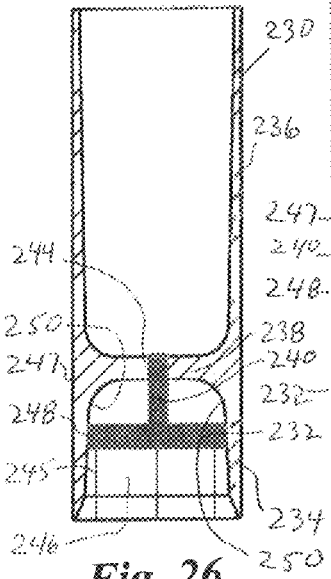
Fig. 26
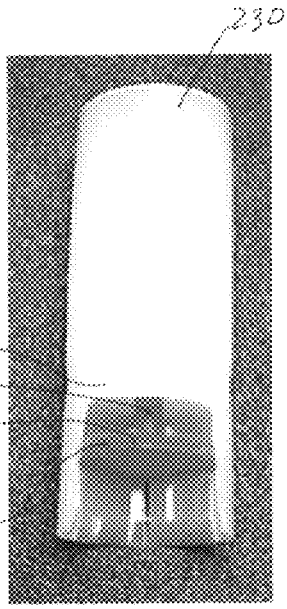
Fig. 27
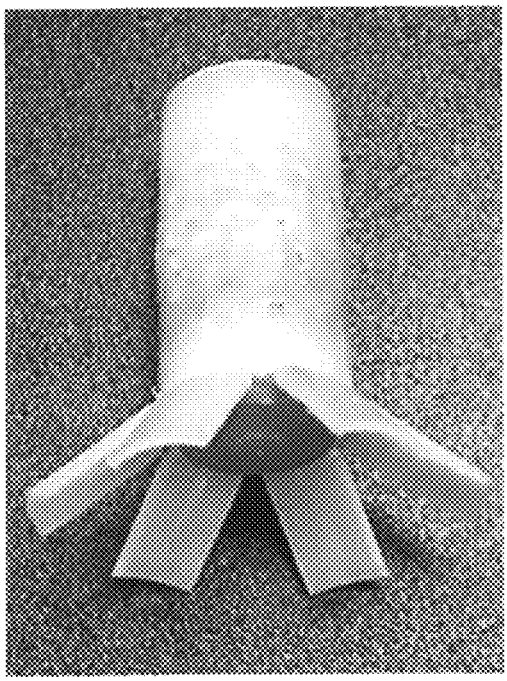
Fig. 28
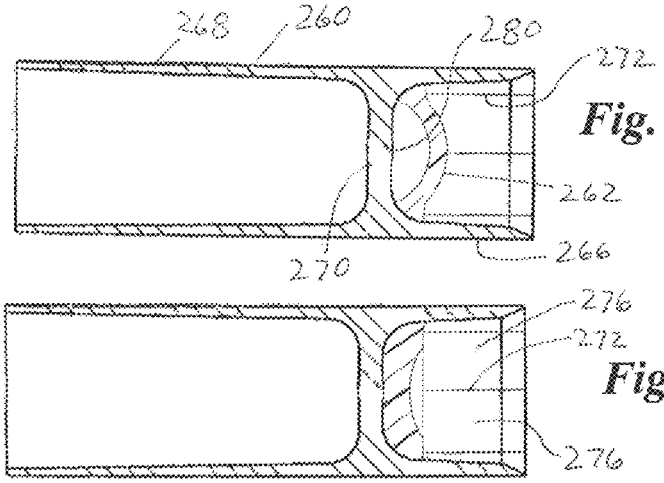
Fig. 29
Fig. 30

SHOTSHELL HAVING WAD WITH ENHANCED FIN DEPLOYMENT

RELATED APPLICATION

This application claims priority to U.S. Provisional Application No. 62/242,177 filed Oct. 15, 2015. Said application is incorporated by reference herein.

BACKGROUND OF THE INVENTION

Shotshell or shotgun cartridges typically comprise a propellant charge, a wad and a shot load, all of which are contained within a plastic or paper shell reinforced at one end with a metal case head to contain and direct the created propellant gases through the opposite end of the cartridge. The shotgun wad typically comprises an injection molded polymer body that obturates against the barrel during firing to prevent escape of propellant gases around the slug or through the shot. The wad often comprises a forward facing cup portion with wings that contains the shot or slug as the shot travels through the barrel. Upon exiting the barrel, aerodynamic drag on the cup portion or the flaring of the fins slows the wad separating the wad from the slug or shot and freeing the projectile(s) to travel onto the target alone.

A primary consideration is determining the performance of a shot loaded shotshell cartridge is determining the maximum effective range at which there is sufficient shot density to accurately strike a target. A standard measurement for determining the effective range of the shotgun cartridge is patterning or measuring the percentage of shot that strikes within a 30 inch circle at 40 yards or other predetermined distance. The tightness of the pattern or the percentage of shot that strikes within the circle can be affected by the size and shape of the shot, the size of the propellant load and the separation point between the wad and the shot. For the purposes of this disclosure, the separation point is the point during flight in which wad dispenses the shot load from the cup portion. To the extent that the separation point can be delayed, the effective range can be extended. However, in conventional wads, the longer the wad remains with the shot during flight, the greater the likelihood that the wad flight will be unstable and will yaw or otherwise have a non-straight flight and will worsen the patterning of the shot load or produce an irregular shot pattern.

Thus the forward wings on the shot cup that deploy almost immediately after leaving the muzzle causing significant aerodynamic drag upon leaving the muzzle with n intended separation point as close to the end of the muzzle as possible.

In certain wads, the wad is commonly formed by four separate wings together defining the walls of the forward cup. The wings flare open immediately upon leaving the muzzle to slow the wad and release the load as soon as possible. Similarly, certain shotgun chokes, such as disclosed in U.S. Pat. No. 7,523,581, slow the wad as the wad passes the choke to begin to separate the shot from the load even before the wad exits the muzzle. In both configurations, the wad is rapidly slowed to facilitate a separation point as close to the muzzle of the barrel as possible.

U.S. Pat. No. 6,260,484 provided a meaningful advancement in maintaining flight stability of the wad with shot permitting wad separation further down the flight path. This is commercially sold as the FLIGHTCONTROL® wad. Referring to FIGS. 1 and 2, a wad 30 as disclosed in the '484 patent is depicted. The wad design provides a dual cup, with a forward shot cup portion 32 and a rearward propellant cup portion 34. The propellant cup portion with fins 40 flares when the wad with shot leaves the muzzle due to high muzzle pressure behind the wad, see FIG. 3. Initially, the high propellant gas pressure as the wad and shot are leaving the barrel is sufficient to momentarily fold the fins forward. The fins then retract to a flared flight position where the fins slow the wad down releasing the shot. The flaring is facilitated by axial cuts 42 in the propellant cup. The flared fins provide stabilization of the wad with shot traveling down the flight path. Additionally, wall segments 44 in the forward shot cup portion open for providing compaction relief of the shot in the shot cup portion facilitating even dispersal and more consistent shot departure from the shot cup. Several manufacturers have adopted features disclosed in the '484 patent. The '484 patent is owned by the applicant of the instant application and is incorporated by reference herein for all purposes.

It has been recognized that different shotgun shells which utilize the rear cup portion fins and the side opening window as disclosed in the U.S. Pat. No. 6,260,484 often exhibit inconsistent patterns when the cartridges are fired in shotguns with ported chokes. See FIG. 4 which represents the failure of the fins to deploy and the resulting instability of the wad and shot. Also, refer to FIG. 5 that illustrates the reduced barrel pressure 48 available to deploy fins at the wad and shot exit point compared to non-choked pressures 50.

See also US 2013/0228090, owned by the owner of the instant application and incorporated herein by reference addressing the advantages of separating the center of pressure and the center of gravity for wad flight stability and certain advantages of using different polymers for the forward shot cup and rearward propellant cup.

SUMMARY OF THE INVENTION

The inventors of the instant application have observed that there is often incomplete or minimal flaring of rearward propellant cup portion fins when the respective cartridges with such wads are fired in a shotgun with a ported choke. This minimal flaring this contributes to yaw and/or tumbling of the wad with the shot still in the wad. The inventors have determined that the drop in muzzle pressures in barrels with ported chokes reduces the forward folding of the fins, compared to a non-choked or a conventional choke. In a non-choked barrel, the muzzle pressures are sufficiently high, as the wad leaves the muzzle, to momentarily fold the fins forwardly beyond a yield point so that the fins do not return to their original predeployed position, they are retained in the flared position. In a ported choked barrel, the fins do not bend past their yield point; they remain resilient, and essentially return to their predeployed state, extending essentially straight rearwardly, with no flare or minimal flare.

Additionally, the inventors have determined that the conventional wall segments in the forward shot cup, in combination with the flared propellant cups, contribute to inconsistent patterns in that they move the center of pressure forwardly and make for an instable projectile. This then may cause the wad with shot therein to yaw or tumble, dramatically effecting the shot pattern. Moreover, such wall segments can be hung up on ported chokes damaging the wad and affecting the performance of the wad and consequently the shot pattern.

In embodiments of the invention, a shotgun shell has a polymer wad with a forward shot cup portion and a rearward propellant cup, the wad in a casing, shot in the shot cup, propellant in the propellant cup, and a primer. The rearward propellant cup portion having enhanced fin deployment such that the shells are operative with shotguns with no chokes, shotguns with ported chokes, and shotguns with conventional chokes. Additionally, in embodiments of the disclosure, the forward shot cup portion has axial slits that are sized to preclude shot from passing therethrough while providing sufficient air circulation to provide compaction relief of the shot pack. In embodiments, further means are provided for retaining the fins uniformly angled rearwardly in an open position as the wad travels down range. Said means for retaining the fins uniformly angled in an open position also does not inhibit the fin opening action when the respective cartridge is used in a wide range of barrel pressures provided by choked and non-choked shotguns, thereby providing the desirable consistent fin flaring independent of the gun in which the cartridge is fired.

In embodiments of the invention, a shotshell cartridge wad has a forward shot cup and a rearward propellant cup, each respectively partially defined by a wad partition portion. The rearward cup having a plurality of deployable fins extending from the partition portion, the deployable fins having a reduced resistance to opening, compared to conventional wads, by suitably configuring a hinge region connecting the fins to the wad partition portion. Additionally, a means for retaining the fins in an open position is provided. In embodiments the means is a rearward projecting portion or portions within the interior of the rearward cup and includes a plurality of gussets extending at a plurality of the deployable fines at an interior corners defined by the wad partition portion and the plurality of fins. In embodiments, rearward projecting portion or portions is configured as a star shaped projecting array centrally positioned on the partition portion with projecting rays extending towards the respective plurality of fins. In embodiments the gusset array has a central portion from which each gusset is connected. Each gusset configured as a web which utilizes the mechanical advantage of the length of each fin with the web near the hinge point to strain the web past the polymer yield point thereby stretching and lengthening the web between the partition portion and the fin, such that respective fin is inhibited from returning to the undeployed position. Utilization of the mechanical advantage to stretch the web allows effective deployment of the fins and outward retention of the fins under a wider a wider operating range of barrel pressures than prior art wads.

A feature and advantage of embodiments is that the central portion may be positioned at an injection molding gate providing for an efficient mold design facilitating the injection molding process of the wad. The gate being centrally positioned with the gussets providing a molten polymer flow path enhancing the size of the flow path, compared to conventional wads, to the forward cup portion and the rearward fins.

In embodiment of the invention, the rearward fins of a shotshell cartridge each having a central internal gusset at a bend zone such that upon exiting the muzzle of a shotgun with a ported choke the fins bend sufficiently to cause the polymer of the gusset to yield, thereby stretching the gusset. This inhibits the gusset from returning to the unflared position, and facilitates maintaining the fins in a flared position. Thus a feature and advantage of embodiments is that a shotshell cartridge with a wad with a shot cup and a propellant cup portion with fins on the propellant cup portion defined by longitudinal slits extending from the rearward edge toward the partition portion. The fins each having a bend zone allowing the fins to open upon leaving a muzzle of a shotgun from which the cartridge is fired, the wad further having a means for retaining the fins in an open positions. In embodiments, said means is a gusset extending between a plurality of the fins and the partition portion, the gusset having a yield point under stress condition, wherein when the yield point is exceeded the gusset permanently extends. Wherein when the cartridge containing the wad is fired in a choked shotgun, the fins deploy sufficiently to pass the yield point to thereby inhibit the return of the respective fins to their original undeployed position.

In embodiments of the invention, a separate component moves axially upon firing to provide a bias to fins to urge or force the fins outwardly upon leaving the muzzle. In embodiments, the separate component is configured as a disk in the propellant cup portion that moves upon ignition of the propellant forwardly in the cup portion to engage cam surfaces of the fins proximate or at their bend zones urging the fins outward. As the wad travels down the barrel, the disk and fins at the cam surfaces are compressed radially outward but the fins are precluded from flaring outward due to the constraints of the barrel. Upon exit from the muzzle, the fins are forced outward by the disk and by the expanding propellant gases. As the fins flare outwardly the disk can inhibit the return of the fins to their prefire undeployed position and can provide a seating position for the fins at a precise angular position with respect to the axis.

In embodiments, the disk may be a positioned in the shot cup portion spaced from the bottom of the cup portion. The fins may have a hinge line or hinge region near the rearward of the disk. Upon firing the inertia of the shot pushes the disk rearwardly where it may engage cam surfaces on the fins to provide a sustained force urging them outwardly. Upon exiting the barrel, the fins deploy outwardly and the wind provided by the moving wad and shot facilitates complete deployment.

In embodiments, the component may be a dome shaped component in the propellant cup portion that upon compression, radially expands thereby providing a sustained radial compressive force on each of the fins proximate bend zones of the fins. Upon exiting the muzzle, the radial compressive force causes or contributes to the fins flaring outwardly. Additionally or alternatively, the component can secure the fins in the flared position by obstructing their return to the unflared position. The component may be secured in a seated position by catches on the component and/or wad, for example circumferential ribs on a central stem. A feature and advantage of embodiments utilizing an axially movable component is that associated with the component an axial space provides a buffer between the expanding propellant gases and the shot that can reduce shot deformation and over compaction in the shot cup portion.

In embodiments, the fins may be positioned close to the base or bottom of the shot cup, and there may be an abbreviated cup portion or no propellant cup portion connected to the shot cup. A disk that is pushed forward upon firing provides outward radial pressure to fins near a bend zone such that they are urged outwardly and upon exiting the muzzle release to a flared position.

In embodiments of the invention, the fins are configured to have predefined fold zones defined by thinning of material or thickening of material at an intended fold line whereby they fold at a much wider range of pressures, in particular, at lower muzzle pressures.

In embodiments of the invention, the propellant cup portion has a plurality of forward facing fins with a bend region positioned proximate the rearward edge of the wads. The fins are separated by axially extending wall sections that support the bend regions at the rearward edge. The fins are defined by a U-shaped cut with the "U" open end facing rearwardly. Upon exiting the muzzle, the gas expansion forces open the window such that bend regions are defined at the junctures of the fins and the axially extending wall sections.

In embodiments the cup portion and shot cup portion may be formed of different materials and joined together such as be welding or by overmolding. This allows use of a readily expandable propellant cup portion with fins, and a much stronger, more rigid shot cup portion.

DESCRIPTION OF THE FIGURES

FIG. 26 is a cross-sectional view of a wad according to an embodiment of the invention.

FIG. 27 is an elevational image of a wad as illustrated in FIG. 26 with a cut-away portion of the cup portion illustrating a disk.

FIG. 28 is a perspective image of the wad of FIG. 27 with the fins deployed.

FIG. 29 is a cross sectional view of a wad with a dome shaped disk in the propellant cup portion according to an embodiment of the invention.

FIG. 30 is a cross sectional view of the wad of FIG. 29 with the dome collapsed by the ignition of the propellant creating an outward force on the fins. In this view the wad would still be in the barrel and the fins constrained from deploying.

DETAILED DESCRIPTION

Figure 6:
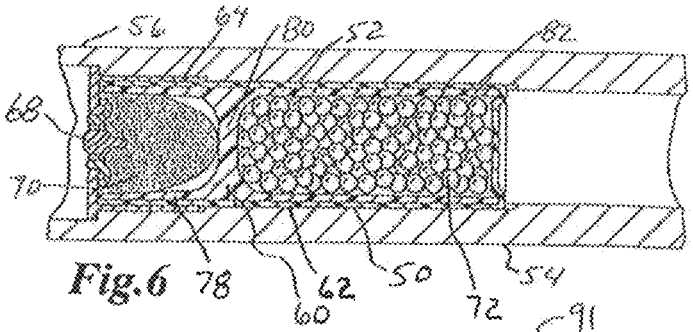
FIG. 6 is a cross sectional view of a shotshell with a wad according to an embodiment of the invention.
Figure 8:
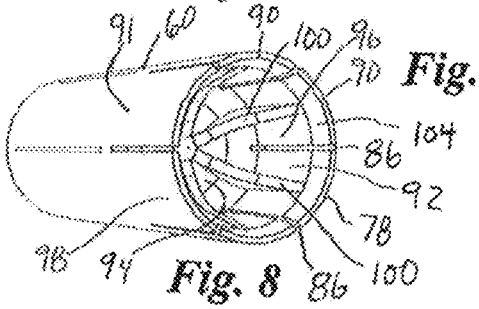
FIG. 8 is an end perspective view of the propellant cup portion of the wad of FIG. 7.
Figure 10:
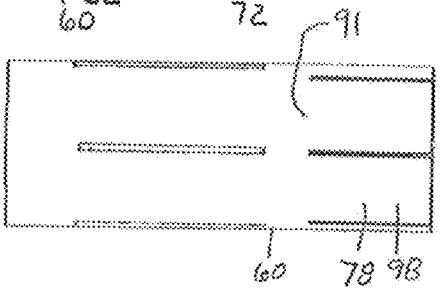
FIG. 10 is a side elevational view of the wad of FIG. 7.
Figure 9:
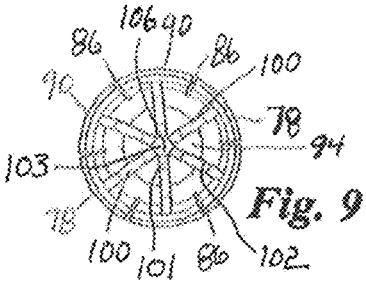
FIG. 9 is an end elevational view of the propellant cup portion of the wad of FIG. 7.
Figure 11:
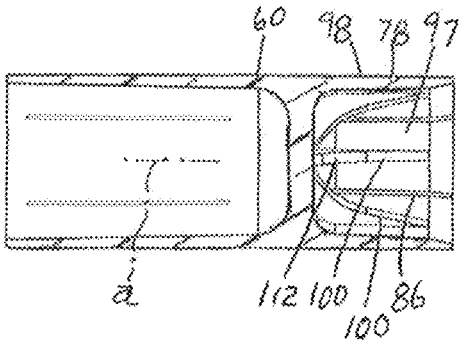
FIG. 11 is a cross sectional view of the wad of FIG. 7.

Referring to FIG. 6, a shotshell cartridge 50 is illustrated in the firing chamber 52 of a barrel 54 of a shotgun 56. The shotshell cartridge 50 is comprised of a wad 60, casing 62, a casing head 64, a primer 68, propellant 70 and shot 72. The wad has a propellant cup portion 78, a partition 80, and a shot cup portion 82.

The wad 60 is shown in detail in prefiring position or form in FIGS. 7-11. The propellant cup portion has a tubular portion 85 with axially extending linear slits 86 that define circumferentially arranged fins 90 therebetween that extend rearwardly from a bend region 91. The wad has a central axis a and the components of the wad are unitary with one another. The propellant cup portion has an interior 92, a bottom 94 at the partition, side walls 96, an interior surface 97, and an exterior surface 98. Each of the fins has an interior gusset 100 configured as a web extending from a forward portion 104 of the fin to a central region 106 on the bottom 94 of the cup portion. The gussets may be a portion of a star-shaped projection 101 with a plurality of rays 102 extending from a central projection portion 103. The central projection positioned at the center of the bottom inside surface of the propellant cup portion.

Figure 1:
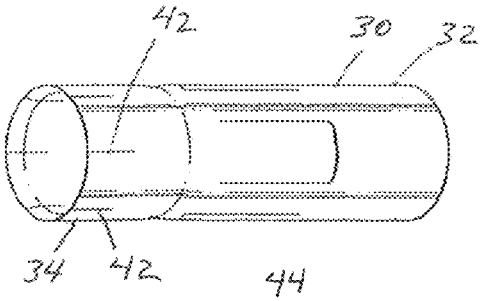
Fig. 1 Prior Art
FIG. 1 is a perspective view of a prior art shotshell wad.
Figure 2:
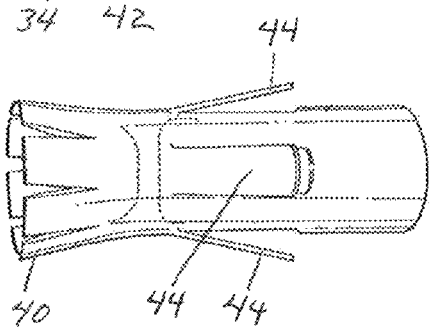
Fig. 2 Prior Art
FIG. 2 is a perspective view of a prior art shotshell wad with fins deployed.
Figure 3:
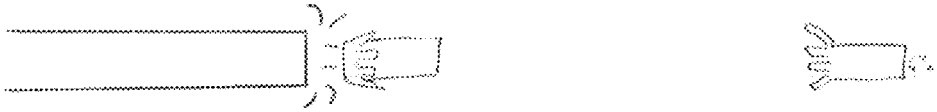
Fig. 3 Prior Art
FIG. 3 is a prior art view of a wad with shot being fired from a shotgun and with the fins of the wad bent forward due to the propellant gas pressure on exit from the barrel and then with the fins retracted to a deployed position during flight.
Figure 4:
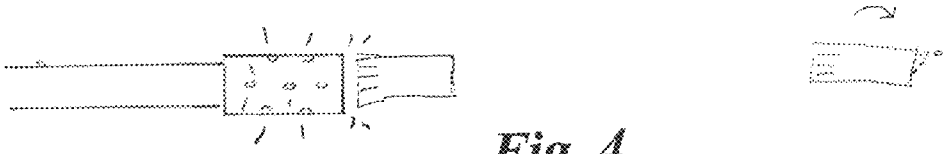
Fig. 4 Prior Art
FIG. 4 is a prior art view of a wad with shot being fired from a shotgun with a ported choke and with the fins of the wad not deployed due to the barrel pressure drop due to the ported choke and the resulting unstable flight.
Figure 5:
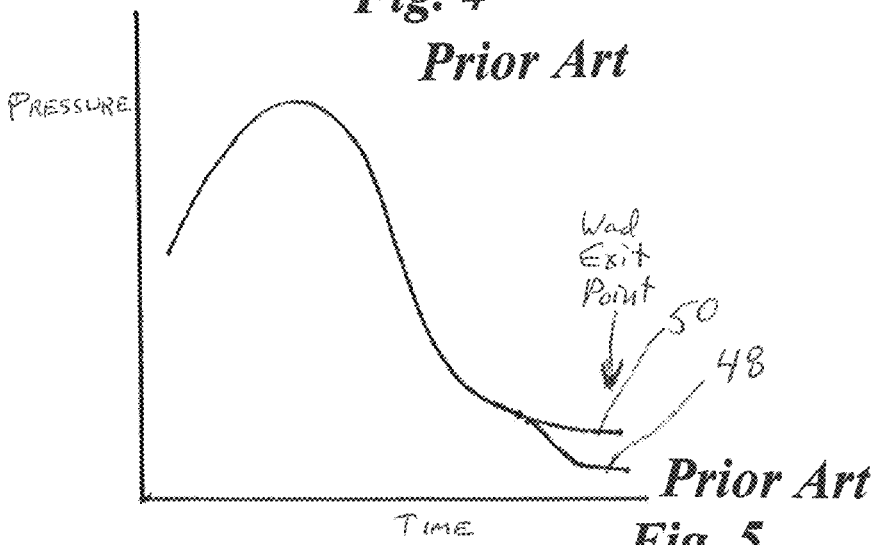
Prior Art Fig. 5
FIG. 5 is an illustration of the barrel pressure drop due to the ported choke.
Figure 7:
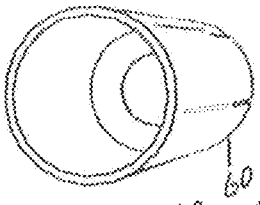
FIG. 7 is an end perspective view of the shot cup portion of a wad according to an embodiment of the invention.
Figure 12:
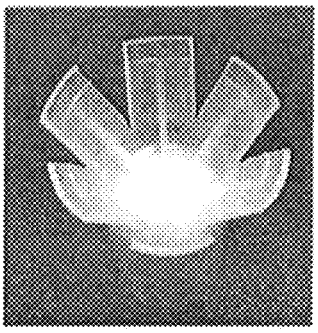
FIG. 12 is a perspective end view image of the wad of FIG. 7 with the fins deployed.
Figure 13:
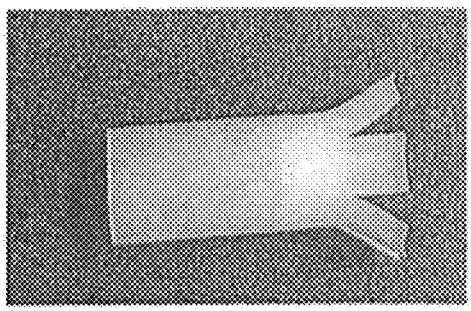
FIG. 13 is a side elevational view image of the wad with the deployed fins of FIG. 12.
Figure 14:
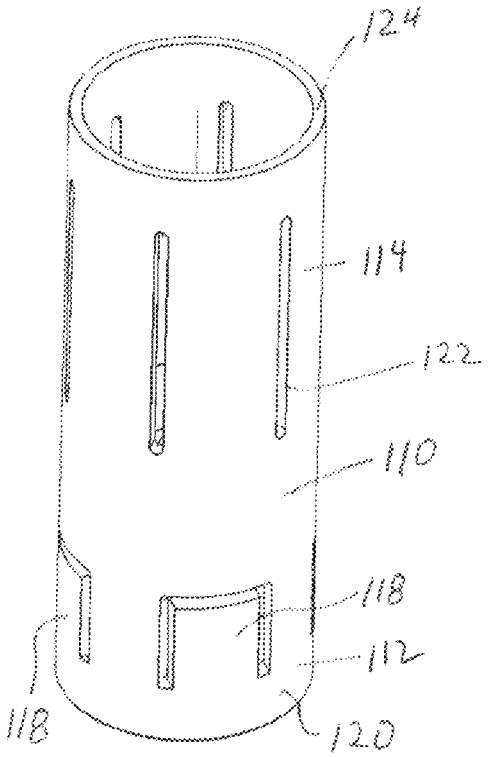
FIG. 14 is perspective view of a wad according to an embodiment of the invention.
Figure 16:
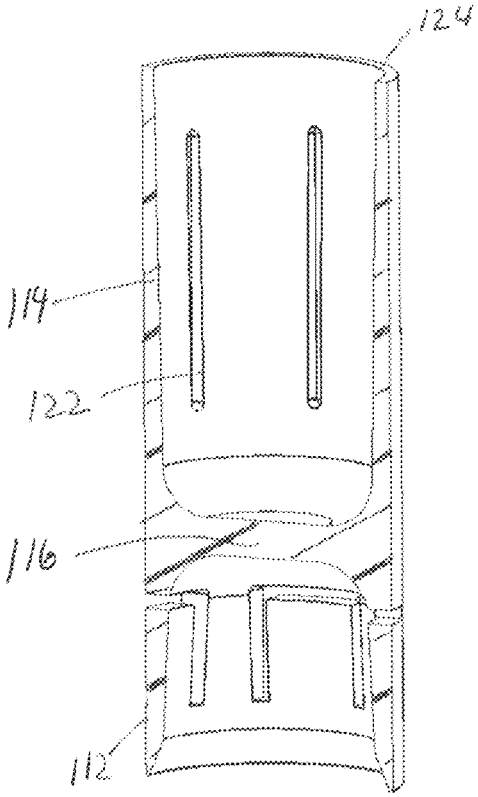
FIG. 16 is a cross sectional view of the wad of FIG. 14.
Figure 15:
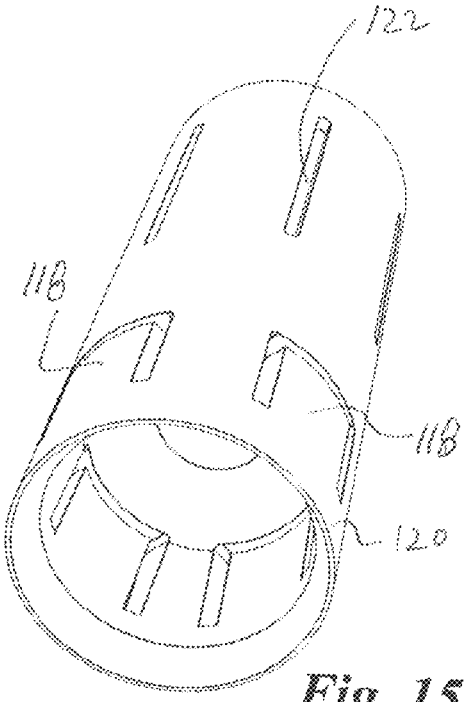
FIG. 15 is an end perspective view of the wad of FIG. 14.

The wad is formed of a polymer such as polyethylene and the gussets are unitarily formed therewith. In the pre fired form or state as shown in FIGS. 6-11, the web provides rigidity to the propellant cup. The web has a mid-portion 112 that is positioned intermediate the gusset portion on the fins and the gusset portion on the bottom. Upon firing, the fins are forced such that the rotate to a yield position as shown in FIG. 3 as the wad leaves the muzzle by the barrel pressure acting within the cup and the gussets are stretched and elongated beyond their yield point such that they do not have any resilience or sufficient resilience to return the fins to their prefired state. Moreover, the gusset has been elongated and thereby inhibits the closing of the fins. Referring to FIGS. 12 and 13, the fins are deployed and are in a relatively fixed deployment position due to the elongated gusset. The initial deployment caused by the expanding propellant gasses just as the wad exits the barrel will typically be at least 90 degrees.

Figure 17:
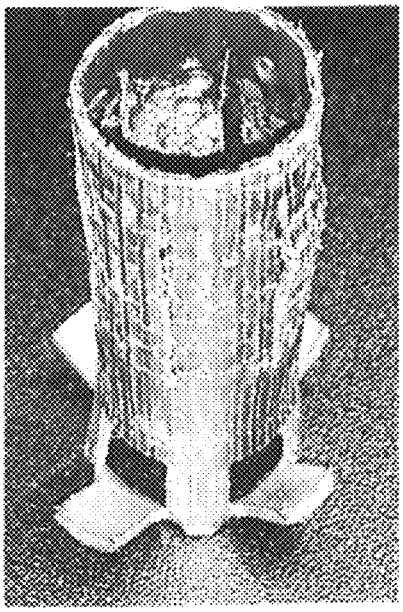
FIG. 17 is a perspective view image of a fired wad as illustrated in FIG. 14 with the fins deployed.
Figure 18:
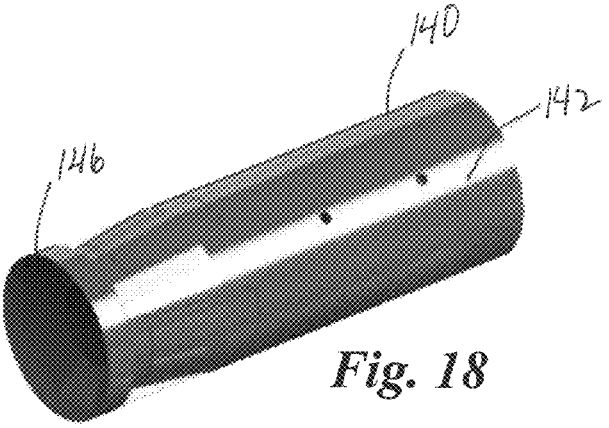
FIG. 18 is a perspective view of a wad according to an embodiment of the invention.
Figure 21:
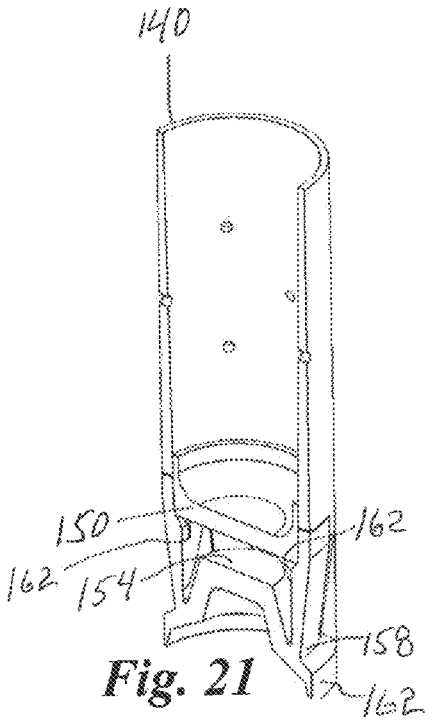
FIG. 21 is a cross sectional view of the wad of FIG. 18.
Figure 19:
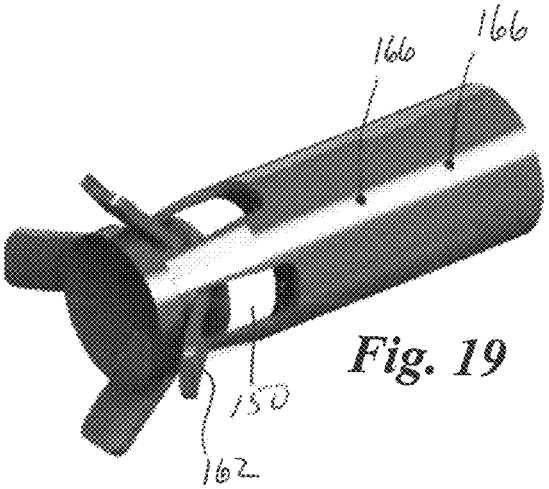
FIG. 19 is a perspective view of the wad of FIG. 18 with shot and a disk after the wad and shot leave the muzzle and with the fins deployed.
Figure 20:
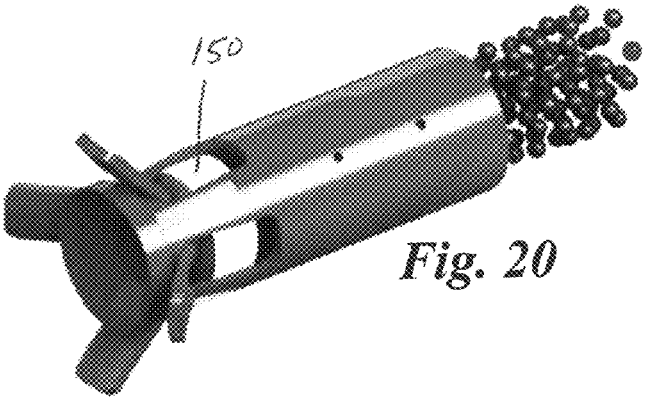
FIG. 20 is a perspective view of the wad and shot of FIG. 19 with the shot leaving the shot cup portion of the wad.
Figure 22:
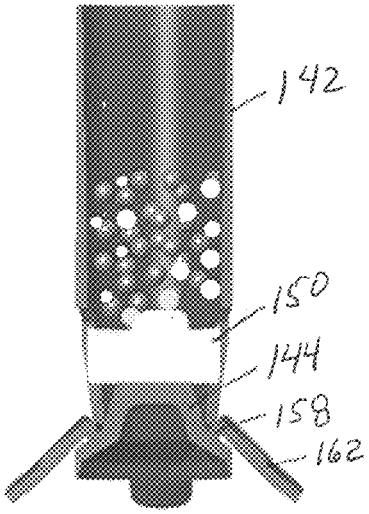
FIG. 22 is a cross sectional view of the wad of FIG. 19.

Referring to FIGS. 14-17, another embodiment is depicted. This wad 110 has a propellant cup portion 112, a shot portion 114, and a partition 116. The fins 118 in this embodiment extend forwardly from a rear edge region 120 of the cup portion 112. Upon firing the shotshell cartridge containing the wad, the propellant in the propellant cup portion ignites and generates expanding propellant gas. The gas pushes outwardly against the fins and when the wad exits the barrel, the fins rotate open about the rear edge region to a deployed state or form as depicted in FIG. 17. The shot portion has slit segments 122 that extend in one direction, axially, and are spaced from the forward edge of the wad. The slits allow air to enter/circulate the shot cup portion to uncompact the shot therein. The slits also permit some circumferential expansion of the shot cup portion after the wad leaves the barrel.

Referring to FIGS. 18-22, an embodiment of a wad 140 that has a shot cup portion 142, a partition 144, and a propellant cup portion 146 that is abbreviated compared to the propellant cup portion of the previous embodiments. A disk 150 may be positioned in the shot cup portion spaced from the bottom 154 of the cup portion. The fins may have a hinge line or hinge region 158 near the rearward edge portion 162 of the disk 150. Upon firing the inertia of the shot pushes the disk rearward, with respect to the wad traveling forward, where it may engage cam surfaces 162 on the fins, providing a sustained force thereto, urging the fins outwardly about the hinge region 158. Upon exiting the barrel, the sustained force continues and the fins deploy outwardly. The wind provided by the moving wad and shot facilitates complete deployment of the fins, the fins are inhibited from overly rotating rearwardly by a stop surface 162 on the shot cup portion 142. After the shot exits the wad, the wad slows, the fins may partially retract. Apertures 166 provide some air circulation to the shot to facilitate loosening of the shot.

Figure 23:
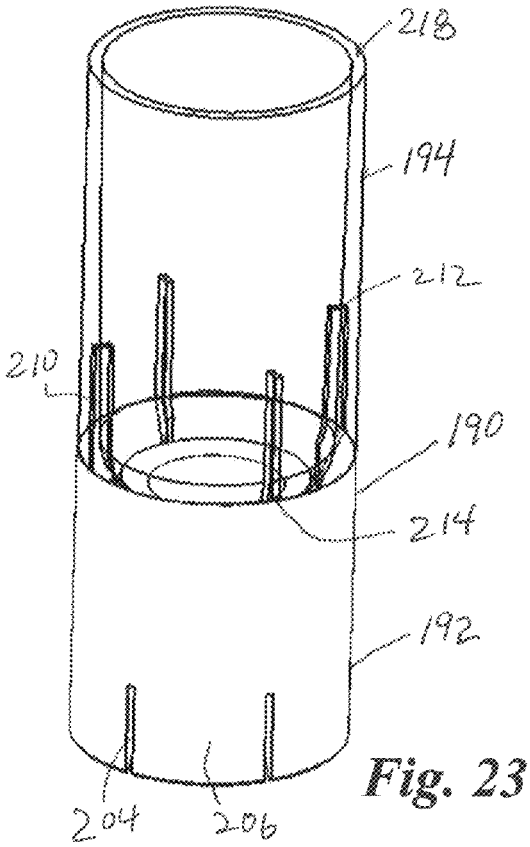
FIG. 23 is a perspective view of a wad according to an embodiment of the invention.
Figure 25:
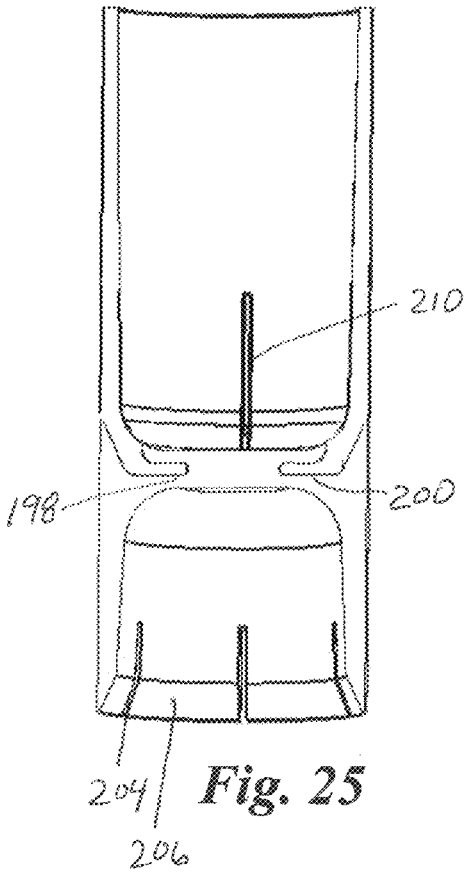
FIG. 25 is a cross-sectional view of the wad of FIG. 23.
Figure 24:
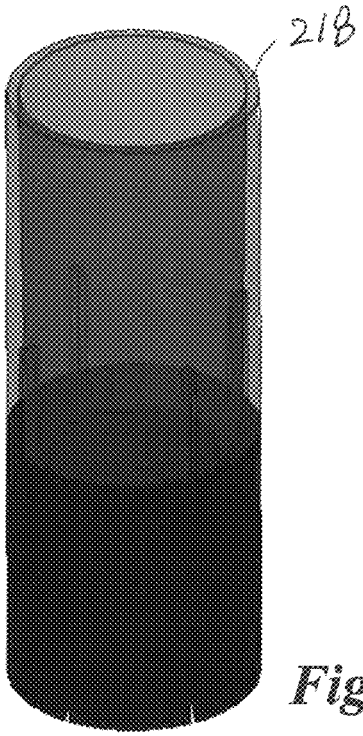
FIG. 24 is a perspective shaded view of the wad of FIG. 23.

Referring to FIGS. 23 to 25, a further embodiment is illustrated where a two shot molding process is utilized. The wad 190 comprises a propellant cup portion 192 formed of a first polymer and a shot cup portion 194 formed of a second polymer. The two cup portions are joined at the partition 198 and have a juncture 200 between the different polymers. The propellant cup portion has slits 204 defining fins 206. The shot cup portion having slit segments 210, each with a forward slit end 212 and a rearward slit end 214. The slit segments are displaced from the forward edge 218 of the wad. The two materials may be mechanically connected as well as adhered to each other by the overmolding process. Such overmolding or dual injection molding can create an intermixing of the polymers at the juncture thereby creating a unitary wad. Either cup portion may be molded first. The fins deploy as described above. Although not illustrated in FIG. 25, the propellant cup portion may utilize the gussets as described with respect to FIGS. 6-13 above.

Referring to FIGS. 26 to 28 a further embodiment of a wad 230 is illustrated utilizing an axially moving disk 232 for effecting an enhancement of the fin deployment. The wad has a propellant cup portion 234, a shot cup portion 236, and a partition 238. The disk 232 has a stem 240 that seats in a central aperture 244 in the partition. Slits 245 define fins 246 extending rearwardly from a bend region 247. When the propellant ignites, the expanding propellant gases drive the disk forwardly and the edges 248 of the disk engage cam surfaces 250 on the fins 246 providing a sustained force thereon urging the fins outward. When the wad escapes the constraint of the barrel, the sustained force deploys the fin. The stem can have catches or interfering portions such that when forced into the aperture 244, it is retained therein. The fins may have gussets as described above.

Referring to FIGS. 29 and 30, a further wad 260 embodiment of the invention is illustrated and comprises a dome shaped disk 262. The wad 260 has a propellant cup portion 266, a shot cup portion 268, and a partition 270. The propellant cup portion has slits 272 defining fins 276 extending rearwardly and may have gussets as described above with respect to FIGS. 6-13. Upon firing, the dome shaped disk is compressed into the bottom 280 of the propellant cup. The axial compression causes a radially outward sustained force that urges the fins outwardly. When the wad exits the barrel, the sustained force aids in deploying the fins, along with the expanding propellant gases.

The invention is not restricted to the details of the foregoing embodiment (s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

We claim:

1. A shotshell cartridge comprising:

a casing with a head portion and a primer, a polymer wad positioned in the casing, the wad having a rearward propellant cup portion defining a rearward cup interior, a forward shot cup portion defining a forward cup interior, a partition separating the rearward cup interior from the forward cup interior, the rearward propellant cup portion having an interior surface and a bottom;

propellant positioned in the propellant cup portion; and shot positioned in the shot cup portion;

wherein the rearward propellant cup portion of the wad having a tubular portion with a plurality of axially extending slits defining a plurality of circumferentially arranged fins extending rearwardly in a prefiring position, each respective fin having a gusset extending axially on an inward side surface of each said respective fin and extending radially inward toward a central region of the partition, the gusset positioned such that an outward bending of each respective fin to a yield position deforms the respective gusset such that the gusset is elongated inhibiting the fin from returning to the prefiring position and thereby providing a deployed position.

2. The shotshell cartridge of claim 1 wherein the shot cup portion of the wad has a plurality of axially extending linear slit segments that are displaced rearwardly from a forward edge of the wad, the plurality of linear slit segments circumferentially spaced around the shot cup portion.

3. The shotshell cartridge of claim 1 wherein the forward shot cup portion and rearward propellant cup portion of the wad are unitary of a single polymer, and wherein the single polymer has a yield point which is exceeded when the cartridge is fired from a choked shotgun whereby each of the plurality of fins extend to at least their respective yield position and are thereby maintained in their respective deployed position.

4. The cartridge of claim 1, wherein each of the gussets of the wad partially defines a star shaped projection extending rearwardly from the partition in the rearward cup interior of the rearward propellant cup portion.

5. The cartridge of claim 4 wherein when viewed axially, each gusset of the wad is spaced intermediate a pair of the plurality of slits.

6. The cartridge of claim 1 wherein the gusset associated with each fin of the wad extends substantially a length of said fin.

7. A shotshell cartridge comprising a wad with a forward shot cup portion defining a forward cup interior and rearward propellant cup portion defining a rearward cup interior, a partition separating the forward cup interior from the rearward cup interior, the rearward propellant cup portion having a rearward edge and a plurality of slits extending from the rearward edge toward the partition, the plurality of slits defining a plurality of deployable fins, the plurality of deployable fins each having a first undeployed position and a second deployed position, the partition having a star shaped projection extending into the rearward cup interior, the star shaped projection having a central projection portion and a plurality of ray portions extending radially outward from the central projection portion, each of the plurality of ray portions oriented toward and centered with a respective one of the plurality of deployable fins, each of the deployable fins movable and retainable at the second deployed position after they are rotated outwardly beyond the second deployed position, the forward shot cup portion having a sidewall with a forward edge and a plurality of axially extending linear elongate slit segments extending through the sidewall and spaced from the forward edge.

8. The shotshell cartridge of claim 7 wherein each of the plurality of axially extending linear elongate slit segments of the wad are sized such that said slit segments do not open far enough for shot pellets to escape therethrough during firing of a shotshell cartridge with the wad therein.

9. The shotshell cartridge of claim 7, further wherein each ray portion of the wad extends to one of the plurality of deployable fins.

10. The shotshell cartridge of claim 9, wherein each ray portion of the wad defines a gusset on each respective deployable fin, each gusset having a yield point wherein when the respective fin is rotated to a yield position, the gusset elongates and inhibits the respective fin from returning to the prefiring position.

11. The shotshell cartridge of claim 10, wherein the rearward propellant cup portion of the wad has a sidewall with a length and the gusset on each respective deployable fin extends in an axial direction.

12. A shotshell cartridge comprising a wad, the wad comprising a forward shot cup portion defining a forward cup interior and rearward propellant cup portion with a base and sidewall defining a rearward cup interior, a plurality of slits extending from a rearward edge of the rearward propellant cup portion axially forward defining a plurality of outwardly deployable fins, a star shaped projection projecting rearwardly from the base of the rearward propellant cup portion into the rearward cup interior, the star shaped projection having a central projection portion and a plurality of ray portions extending radially outward from the central projection portion toward the sidewall each of the plurality of ray portions oriented toward and centered with a respective one of the plurality of deployable fins.

13. The shotshell cartridge of claim 12 wherein each deployable fin has a bend region and the ray portion oriented toward and centered with respect to each said deployable fin extends to a bend region of each said deployable fin, each ray portion providing a yieldable gusset whereby an outward bending of each said respective fin deforms the respective gusset such that the gusset is elongated inhibiting the fin from returning to a pre bending position.

* * * * *